US006257872B1

(12) United States Patent
Williams

(10) Patent No.: US 6,257,872 B1
(45) Date of Patent: Jul. 10, 2001

(54) DECORATIVE CIGARETTE LIGHTER APPARATUS

(76) Inventor: J. M. (Jack) Williams, 8430 Gold Creek, Houston, TX (US) 77080

( * ) Notice: Subject to any disclaimer, the term of this patent is extended or adjusted under 35 U.S.C. 154(b) by 0 days.

(21) Appl. No.: 09/411,297

(22) Filed: Oct. 4, 1999

(51) Int. Cl.[7] ..... F21V 33/00

(52) U.S. Cl. ..... 431/253; 431/126; 40/299; 40/306

(58) Field of Search ..... 431/253, 125, 431/126, 343; 40/665, 299, 309, 305, 306, 334, 329, 310, 905; D20/19, 22, 24

(56) References Cited

U.S. PATENT DOCUMENTS

| | | | | |
|---|---|---|---|---|
| D. 386,211 | * | 11/1997 | Taparaushas, Jr. | D20/22 |
| 405,102 | * | 6/1889 | Kraus . | |
| D. 407,343 | * | 3/1999 | Dickhaut | D11/26 |
| D. 412,938 | * | 8/1999 | Kesselring et al. | D20/28 |
| 415,116 | * | 11/1889 | Michel . | |
| 1,298,621 | * | 3/1919 | Wrigley . | |
| 2,812,652 | * | 11/1957 | Conley | 431/126 |
| 3,706,523 | * | 12/1972 | Kumm | 431/126 |
| 3,965,591 | * | 6/1976 | Le Sueur . | |
| 5,283,969 | * | 2/1994 | Weiss | 40/633 |
| 5,651,388 | * | 7/1997 | Faran, Jr. | 40/299 |

FOREIGN PATENT DOCUMENTS

| | | | | |
|---|---|---|---|---|
| 0870684 | * | 10/1998 | (EP) . | |
| 2410323 | * | 7/1979 | (FR) | 431/126 |

* cited by examiner

*Primary Examiner*—Carl D. Price
(74) *Attorney, Agent, or Firm*—Bill B. Berryhill

(57) ABSTRACT

Decorative apparatus for removable attachment to a cigarette lighter the body of which tapers upwardly and inwardly from its base to the top thereof. The apparatus includes a rigid band the interior of which is smaller than the cross-sectional area of the lighter base but larger than the cross-sectional area of the lighter top. One or more distinctive members may be affixed to the band for enhancing appearance and identification.

7 Claims, 1 Drawing Sheet

DECORATIVE CIGARETTE LIGHTER APPARATUS

BACKGROUND OF THE INVENTION

1. Field of the Invention

The present invention pertains to apparatus for use with a cigarette lighter. More specifically, the present invention pertains to decorative apparatus for removable attachment to a cigarette lighter for enhancing the appearance and/or identification of the lighter.

2. Brief Description of the Prior Art

Cigarette lighters have existed for many years. The body of such lighters enclose a reservoir in which lighter fluid is carried for supplying a flame producing element which is ignited as needed.

In the past, cigarette lighters have been manufactured as a relatively permanent devices which may be kept by the owner for many years, lighter fluid being replenished through a filler opening. Most of the bodies of such lighters were made of metal and many were very decorative in appearance, some being provided with precious metal or stone decorations or designs.

In more recent years, the disposable cigarette lighter has become much more popular. The body of such disposable cigarette lighters are usually made of plastic and are relatively cheap. Once the lighter fluid of a disposable lighter is depleted, the lighter is simply thrown away and a new one purchased by the user. Such lighters are much safer in that they do not require refilling and are not as likely to leak. Furthermore, the user does not have to worry as much about losing an expensive lighter.

Since disposable cigarette lighters are mass produced and vary little in appearance, they are rather plain and non-descriptive in appearance. Thus, they are lacking in characteristics of individual design and identification, characteristics often desired by the users thereof.

SUMMARY OF THE PRESENT INVENTION

The present invention provides a removable attachment to a cigarette lighter which comprises a rigid band which may be placed around a cigarette lighter in a position snugly engaging a mid-portion thereof. One or more distinctive design members may be affixed to the band enhancing the appearance and/or identification of the lighter. Since most cigarette lighters are tapered upwardly and inwardly from the base thereof, the band is formed with an interior which is smaller than the cross-sectional area of the lighter base but larger than the cross-sectional area of the lighter at the top thereof. This allows the apparatus to be placed around the top of the lighter and moved to a position snugly engaging the mid-portion of the lighter body. If the lighter is a disposable lighter, the apparatus may be removed when fluid in the lighter is depleted by simply grasping it and removing it from the top of the lighter. It may then be placed on a newly purchased lighter.

The decorative apparatus of the present invention may be made from precious metals, such as silver and gold, and provided with one or more distinctive design elements for enhancing the appearance and/or individualized identification of the lighter. While the apparatus of the present invention is simple in design and use, it is unique in providing decorative apparatus for disposable cigarette lighters which may be used again and again to enhance the appearance of the lighter and to identify it as belonging to a particular individual. Many other objects and advantages of the invention will be apparent from reading the description which follows in conjunction with accompanying drawings.

DESCRIPTION OF A PREFERRED EMBODIMENT

Figure 1:
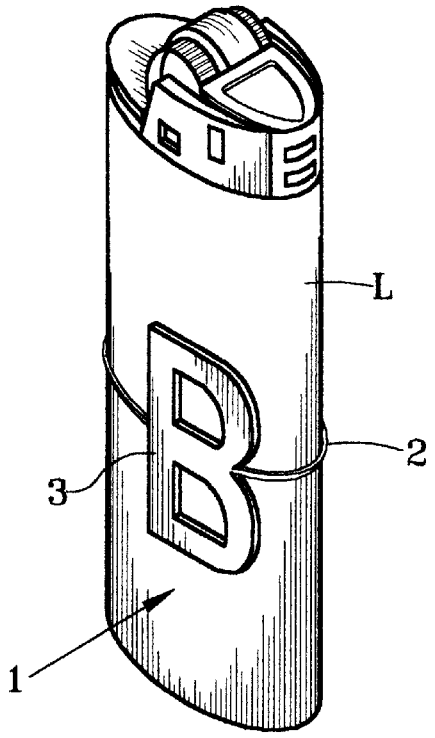
FIG. 1 is a perspective view of a disposable cigarette lighter to which is removably attached decorative apparatus for enhancing the appearance and/or identification of the lighter, according to a preferred embodiment thereof.

Referring first to FIG. 1 there is shown a cigarette lighter L. The cigarette lighter L illustrated is of a disposable type which is normally made with a plastic body in which is a reservoir (not shown) of lighter fluid. Once the lighter fluid is depleted, the cigarette lighter is simply thrown away and a new one purchased. The typical disposable lighter, such as the one L shown in FIG. 1, is elliptical in cross section and tapers upwardly and inwardly from the base thereof toward the top in a very slight taper.

Figure 2:
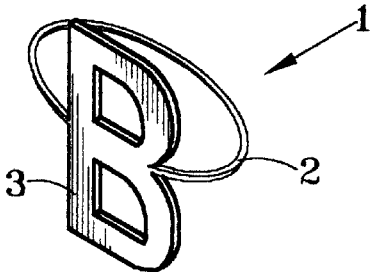
FIG. 2 is a perspective of the decorative apparatus of the present invention such as the one shown in FIG. 1, according to a preferred embodiment thereof.
Figure 3:
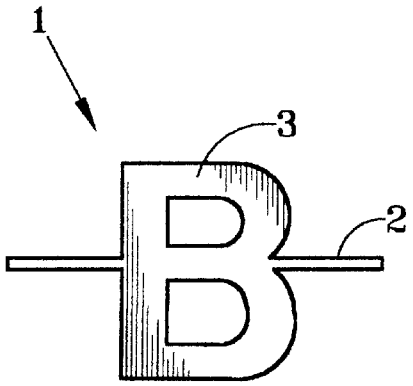
FIG. 3 is a side view of the decorative apparatus of FIG. 2.
Figure 4:
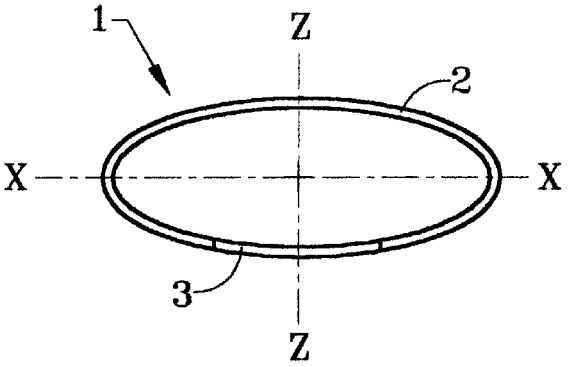
FIG. 4 is a top view of the decorative apparatus of FIGS. 2 & 3.

Referring also now to FIGS. 2, 3 and 4, the decorative apparatus 1 is provided with a rigid band 2 the interior of which is smaller than the cross sectional area of the base of the lighter L on which it is to be used but which is larger than the cross sectional area of the lighter top. This allows the band 2 to be placed around a lighter top and moved to a position snugly engaging a mid-portion of the lighter body as illustrated in FIG. 1.

As illustrated in FIG. 1, the lighter is elliptical in cross section. Thus the band 2 is also elliptical having a major axis X—X and a minor axis Z—Z, as illustrated in FIG. 4, which corresponds with the major and minor axes of a mid-portion of a lighter L.

One or more distinctive design members 3 may be affixed to the band 2 for enhancing the appearance and/or identification of the lighter. In the exemplary embodiment, the design member is the letter "B", perhaps the first initial of the user's last name identifying the lighter as his or hers. Of course any number of distinctive designs could be substituted for the letter B. Initials, company logos, state and national symbols, fraternal organization emblems and any other type of design may be affixed to the ring 2.

Since the ring 2 and the design member 3 are permanent in nature they may be made of silver, gold or other precious metals and may be enhanced with precious or semi-precious stones or other design elements. The band 2 might be made of small diameter wire like material or of much wider width. Any number of variations in the design of the band 2 and design member 3 may be utilized as long as the basic design is adhered to. Thus, while many variations of the invention may be made by those skilled in the art, it is intended that the scope of the invention be limited only by the claims which follow.

What is claimed is:

1. In combination, a cigarette lighter the body of which tapers upwardly and inwardly from its base to the top thereof and a rigid continuous decorative band the interior of which is smaller than the cross-sectional area of said lighter base but larger than the cross-sectional area of said lighter top, allowing said band to be placed around said lighter top and removably positioned to snugly engage a mid-portion of said lighter body.

2. The combination set forth in claim 1 including one or more distinctive design members affixed to said band for enhancing the appearance and/or identification of said lighter.

3. The combination set forth in claim 1 in which said lighter is elliptical in cross-section, the interior of said band also being elliptical and having a major axis and a minor axis which corresponds with the major and minor axes of said mid-portion of said lighter body.

4. In combination, a cigarette lighter the body of which is elliptical in cross-section tapering inwardly and upwardly from its base to the top thereof and a decorative elliptical band the interior of which is smaller than the cross-sectional area of said lighter base but larger than the cross-sectional area of said lighter top thereof, allowing said band to be placed around said lighter top and moved toward said bottom to a position snugly engaging a mid-portion of said lighter body, said band being removable from said lighter by moving toward said top thereof.

5. The combination set forth in claim 4 including at least one distinctive design element affixed to said band for enhancing the appearance and/or identification of said lighter.

6. The combination set forth in claim 5 in which the interior of said band has major and minor axes which correspond with major and minor axes of said mid-portion of said lighter.

7. The combination set forth in claim 4 in which the interior of said band has major and minor axes which correspond with major and minor axes of a portion of said lighter body midway between said base and said top thereof.

* * * * *